US007661452B1

(12) United States Patent
Krioukov et al.

(10) Patent No.: US 7,661,452 B1
(45) Date of Patent: Feb. 16, 2010

(54) WASHER AND DRYER COVER WHICH FULLY ENCLOSES THE TOP AND THE SIDE OF THE WASHER AND DRYER

(75) Inventors: Oleg Krioukov, 612 Pacific St., No. 6, Santa Monica, CA (US) 90405; Alan Flig, Los Angeles, CA (US)

(73) Assignees: Oleg Krioukov, North Hollywood, CA (US), part interest; Marina Chasnik, Los Angeles, CA (US), part interest ( * ) Notice: Subject to any disclaimer, the term of this patent is extended or adjusted under 35 U.S.C. 154(b) by 593 days.

(21) Appl. No.: 11/266,896

(22) Filed: Nov. 3, 2005

(51) Int. Cl.
*B65D 65/02* (2006.01)

(52) U.S. Cl. ..... 150/165; 206/320; 206/818; 68/3 R

(58) Field of Classification Search ..... 150/165; 206/320, 818; 68/3 R, 196; 434/23; 428/524.6, 428/692.1; 335/219; 24/303
See application file for complete search history.

(56) References Cited

U.S. PATENT DOCUMENTS

| | | | | | |
|---|---|---|---|---|---|
| D119,513 | S | * | 3/1940 | Wolff | D32/25 |
| 3,124,501 | A | * | 3/1964 | Wise | 428/167 |
| 3,500,044 | A | * | 3/1970 | Treadway | 68/196 |
| 3,529,881 | A | * | 9/1970 | Kaldenberg | 312/276 |
| D249,882 | S | * | 10/1978 | Genaro et al. | D14/149 |
| 4,310,978 | A | * | 1/1982 | Stern | 40/600 |
| 4,810,015 | A | * | 3/1989 | McNeil | 293/128 |
| 5,117,807 | A | * | 6/1992 | Graulich | 126/190 |
| 5,496,104 | A | * | 3/1996 | Arnold et al. | 312/204 |
| 5,549,938 | A | * | 8/1996 | Nesbitt | 428/17 |
| D373,664 | S | * | 9/1996 | Jackson | D32/25 |
| D449,195 | S | * | 10/2001 | Brown | D6/610 |
| 6,457,334 | B1 | | 10/2002 | Harker | |
| 6,840,773 | B2 | * | 1/2005 | Anderson et al. | 434/73 |
| D503,999 | S | * | 4/2005 | Arvizo | D32/25 |
| 7,299,573 | B1 | * | 11/2007 | Kuncken | 38/140 |
| 2008/0104872 | A1 | * | 5/2008 | Mertz | 40/600 |

FOREIGN PATENT DOCUMENTS

DE 4223636 A1 * 1/1994

* cited by examiner

*Primary Examiner*—Sue A Weaver
(74) *Attorney, Agent, or Firm*—Thomas I. Rozsa

(57) ABSTRACT

The present invention is a cover for a washer and dryer made of windowless waterproof material which covers the entire top portion and front side portion of the washer and dryer so that moisture and other elements cannot seep onto the washer and dryer at the location of the washer entry door and the dryer entry door. Optionally, the present invention also includes a side cover which covers and protects the left and right sides of the washer and dryer. The cover is retained on the washer or dryer by magnets located on a rubber bumper positioned on the inside side apron of the cover so that the cover remains in place and further permits a portion of the cover to be rolled back to expose an entry door. Magnets beneath the top portion and the front side portion further serve to keep the cover in place on the washer or dryer.

19 Claims, 4 Drawing Sheets

WASHER AND DRYER COVER WHICH FULLY ENCLOSES THE TOP AND THE SIDE OF THE WASHER AND DRYER

BACKGROUND OF THE INVENTION

1. Field of the Invention

The present invention generally relates to the field of protective devices for appliances and more particularly, the present invention relates to the field of covers for residential and commercial washers and dryers.

2. Description of the Prior Art

Residential and commercial washers and dryers, especially if they are left outside, are often subject to hazardous elements and the environment which may damage the washer and dryer or cause it to corrode. It is therefore desirable to place a cover over the washer and dryer to protect it from such hazardous elements or the environment.

One such washer and dryer cover know in the prior art is U.S. Pat. No. 6,457,334 B1 issued to Ann Harker and Cameron Harker on Oct. 1, 2002 for "Covering Device For Washers And Dryers."(hereafter the "Harker Patent"). The Harker Patent discloses a washer and dryer cover where the cover has a flap which opens to expose the entry door of the top loading washer and the entry door of a side loading dryer. The cover fits over the entire washer and dryer assembly ands cannot be easily removed. In addition the flaps to gain entrance to the washer entry door and dryer entry door provide a gap where moisture such as rain can seep into the area and corrode the washer and dryer or otherwise cause damage to it.

Therefore there is a significant need for a washer and dryer cover which eliminates the problems associated with the device disclosed in the Harker Patent.

SUMMARY OF THE INVENTION

The present invention is a cover for a washer and dryer made of windowless waterproof material which covers the entire top portion and front side portion of the washer and dryer so that moisture and other elements cannot seep onto the the washer and dryer at the location of the washer entry door and the dryer entry door. Optionally, the present invention also includes a side cover which covers and protects the left and right sides of the washer and dryer. The cover is retained on the washer or dryer by magnets located on a rubber bumper positioned on the inside side apron of the cover and at other locations on the inside of the cover so that the cover remains in place and further permits a portion of the cover to be rolled back to expose an entry door.

It has been discovered, according to the present invention, that if the cover contains side portions on both the top and front side which contain magnets which affix the cover to the washer or dryer, and additionally contains magnets at an interior location adjacent to the horizontal front top of the washer or dryer and adjacent to the vertical front top of the washer or dryer, then a portion of the cover such as either the top or the front side can be rolled back to expose an entry door while the remainder of the cover stays in place on the washer or dryer.

It has also been discovered, according to the present invention, that if the interior side portion of the cover which rests adjacent the left side and the right side of the cover have incorporated therein means such as a rubber strip or bumper which supports a magnet, and further contains means which supports a magnet at a location on the interior portion of the cover which rests adjacent the horizontal front top of the washer or dryer and adjacent the vertical front top of the washer or dryer, then the magnets will cause the cover to remain in place on the washer and dryer and permit a portion of the cover such as the top or front side to be rolled back to expose a top or front side entry door while the remainder of the cover remains in place on the washer or dryer.

It has further been discovered, according to the present invention, that if the washer or dryer cover is waterproof for both indoor and outdoor use and covers the entire washer and dryer and is windowless, then the washer and dryer will be protected from the elements and water or other corrosive material cannot seep into the area of the entry doors to damage the washer or dryer.

It has additionally been discovered, according to the present invention, that if the cover is form fitted to the washer and/or dryer, it will be more secure and better assure that no hazardous elements can come in contact with the washer or dryer.

It has also been discovered, according to the present invention, that if the cover has an exterior made of vinyl and an interior made of foam, felt or other thick material, the vinyl exterior will be waterproof to protect the washer and dryer from the elements and the foam, felt or other thick material will provide protection to the surface of the washer and dryer.

It is therefore an object of the present invention to provide a cover which contains side portions on both the top and front side which contain magnets which affix the cover to the washer or dryer, and additionally contains magnets at an interior location adjacent to the horizontal front top of the washer or dryer and adjacent to the vertical front top of the washer or dryer, so that a portion of the cover such as either the top or the front side can be rolled back to expose an entry door while the remainder of the cover stays in place on the washer or dryer.

It is also an object of the present invention to provide a cover which has interior side portions which rest adjacent the left side and the right side of the cover and which have incorporated therein means such as a rubber strip or bumper which supports a magnet, and further contains means which supports a magnet at a location on the interior portion of the cover which rests adjacent the horizontal front top of the washer or dryer and adjacent the vertical front top of the washer or dryer, so that the magnets will cause the cover to remain in place on the washer and dryer and permit a portion of the cover such as the top or front side to be rolled back to expose a top or front side entry door while the remainder of the cover remains in place on the washer or dryer.

It is a further object of the present invention to provide a washer or dryer cover that is waterproof for both indoor and outdoor use and covers the entire washer and dryer and is windowless, so that the washer and dryer will be protected from the elements and water or other corrosive material cannot seep into the area of the entry doors to damage the washer or dryer.

It is an additional object of the present invention to provide a cover that is form fitted to the washer and/or dryer so that it will be more secure and better assure that no hazardous elements can come in contact with the washer or dryer.

It is another object of the present invention to provide a cover which has an exterior made of vinyl and an interior made of foam, felt or other thick material and making the vinyl exterior waterproof to protect the washer and dryer from the elements and so that the foam, felt or other thick material will provide protection to the surface of the washer and dryer.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
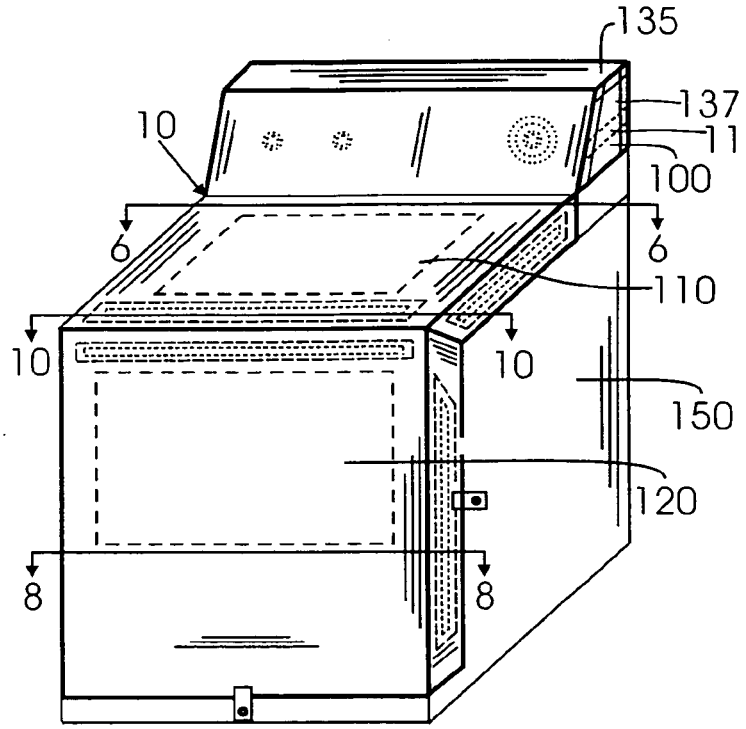
FIG. 1 is a perspective view of the present invention cover for a washer or dryer illustrating a top entry door and a side entry door in dashed lines.
Figure 2:
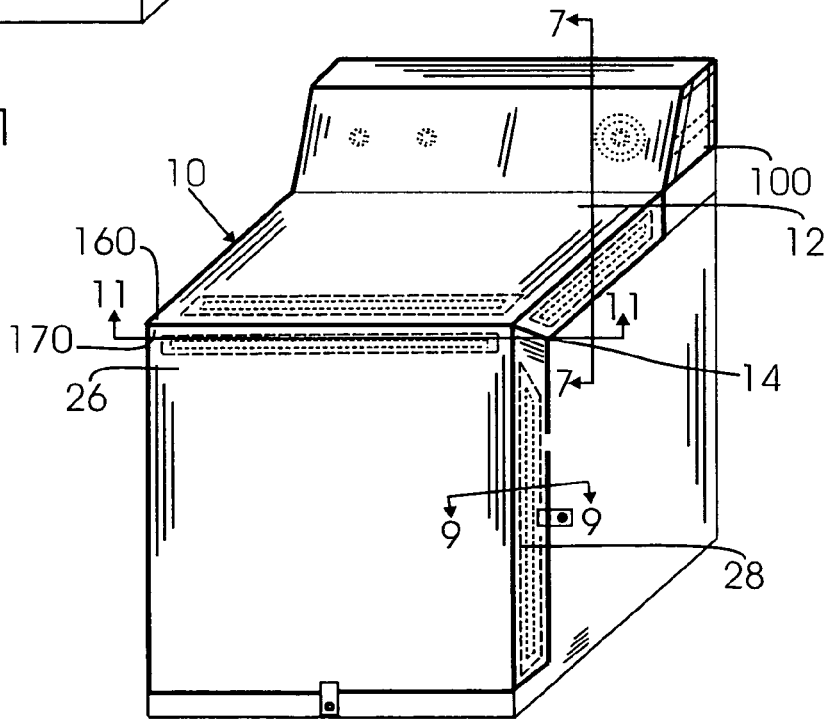
FIG. 2 is a perspective view of the present invention cover for a washer or dryer in place on a washer or dryer.

Referring to FIGS. 1 and 2, there is shown at 10 the present invention washer and dryer cover in place on a washer or dryer 100. In FIG. 1, the access door 110 for a top loading washer or dryer is illustrated in dashed lines. Also in FIG. 1, the access door 120 for a front loading washer or dryer is illustrated in dashed lines. The washer or dryer 100 has a top 130, a control panel 135, and a front side 140, and right side 150 and an oppositely disposed left side.

Figure 6:
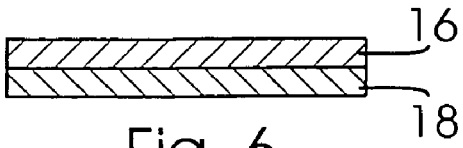
FIG. 6 is a cross-sectional view taken along line 6-6 of FIG. 1.
Figure 7:
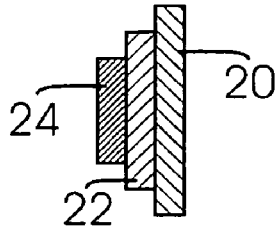
FIG. 7 is a cross-sectional view taken along line 7-7 of FIG. 2.

The washer or dryer cover 10 has a top section 12 with a first side panel 14 and an oppositely disposed second side panel. The top section 12 covers the top 130 of the washer or dryer 100 and also covers the control panel 135 of the washer or dryer. At each side location 137 of the control panel 135, the cover 12 has a rubber strip 11 to maintain the top section 12 of the cover 10 in place. Although only the right side 137 and rubber strip 11 is illustrated, it will be appreciated that a duplicate rubber strip 11 is positioned on the opposite side 137 of the control panel 135. As illustrated in the cross-sectional view of FIG. 6, the top section 12 has two layers, a top layer 16 and a bottom layer 18. Top layer 16 is made of waterproof material such as vinyl. Interior or second layer 18 is made of softer cushioning material such as foam or felt or other thick material. As illustrated in the cross-sectional view of FIG. 7, the side panel has and further contains means which supports a magnet at a location on the interior portion of the cover which rests adjacent the horizontal front top of the washer or dryer and adjacent the vertical front top of the washer or dryer, then the magnet swill cause the cover to remain on the washer or dryer cover on the right side 150 metal frame of the washer or dryer 100. It will be appreciated that the side panel on the opposite side of the washer or dryer is also formed of an exterior cover layer, a support layer such as rubber and a magnet supported on the support layer.

Figure 8:
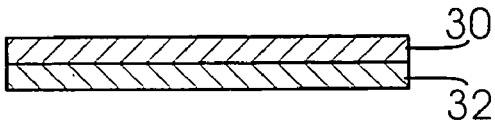
FIG. 8 is a cross-sectional view taken along line 8-8 of FIG. 1.
Figure 9:
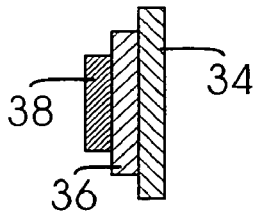
FIG. 9 is a cross-sectional view taken along line 9-9 of FIG. 2.

The washer or dryer cover 10 has a front side section 26 with a first side panel 28 and an oppositely disposed second side panel. The front side section 26 covers the front side 140 of the washer or dryer 100. As illustrated in the cross-sectional view of FIG. 8, the front side section 26 has two layers, a top layer 30 and a bottom layer 32. Top layer 30 is made of waterproof material such as vinyl. Interior or second layer 32 is made of softer cushioning material such as foam or felt or other thick material. As illustrated in the cross-sectional view of FIG. 9, the side panel has the exterior layer 34 made of vinyl and an interior supporting layer 36 made of material such as rubber which supports a magnet 38 thereon. The magnet serves to retain the washer or dryer cover on the right side 150 metal frame of the washer or dryer 100. It will be appreciated that the side panel on the opposite side of the front side 26 of the washer or dryer cover is also formed of an exterior cover layer, a support layer such as rubber and a magnet supported on the support layer.

Figure 10:
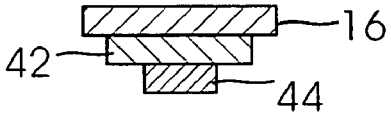
FIG. 10 is a cross-sectional view taken along line 10-10 of FIG. 1.
Figure 11:
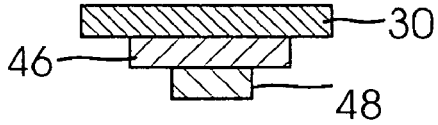
FIG. 11 is a cross-sectional view taken along line 11-11 of FIG. 2.

There are also two optional magnets to further help keep the cover 10 in place. As illustrated in the cross-sectional view of FIG. 10-10, the top 12 at the location adjacent the horizontal front 160 of the washing machine 100 has the exterior layer 16 but instead of the inner layer 18 has a supporting layer 42 in a cut out portion of interior layer 18 made of material such as rubber which supports a magnet 44. As illustrated in the cross-sectional view of FIG. 11-11, the front section 26 at the location adjacent the vertical top 170 of the washing machine 100 has the exterior layer 30 but instead of the inner layer 32 has a supporting layer 46 in a cut out portion of interior layer 32 made of material such as rubber which supports a magnet 48. These two additional magnets help keep the cover 10 aligned on the washing machine 100 and also helps keep the remaining portion of the cover in place when the top 12 is rolled back to expose the top entry door 110 or the front 26 is rolled upwardly to expose the front entry door 120.

Figure 3:
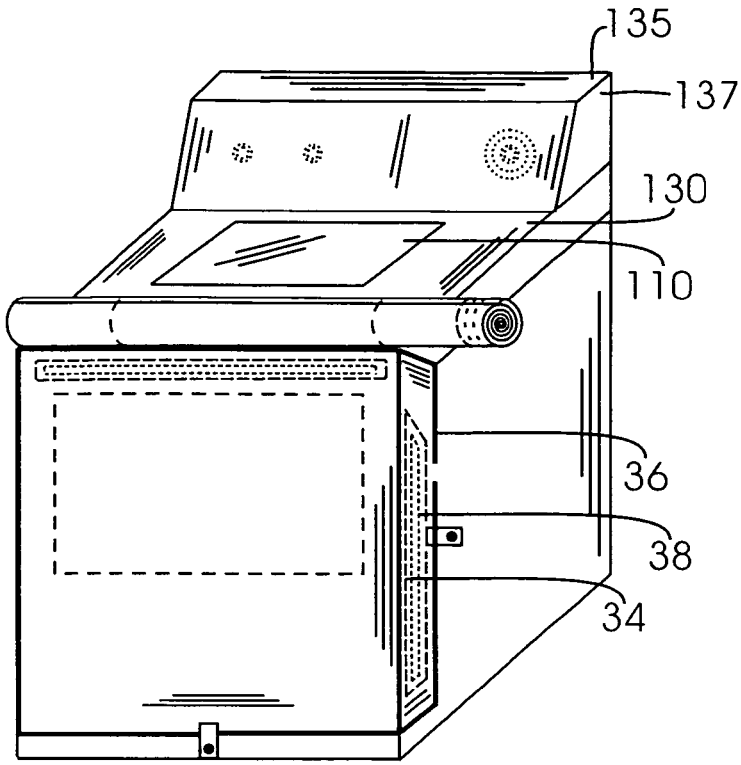
FIG. 3 is a perspective view of the present invention cover for a washer or dryer with the top portion of the cover rolled back to gain exposure to the top entry door for a washer or dryer.
Figure 4:
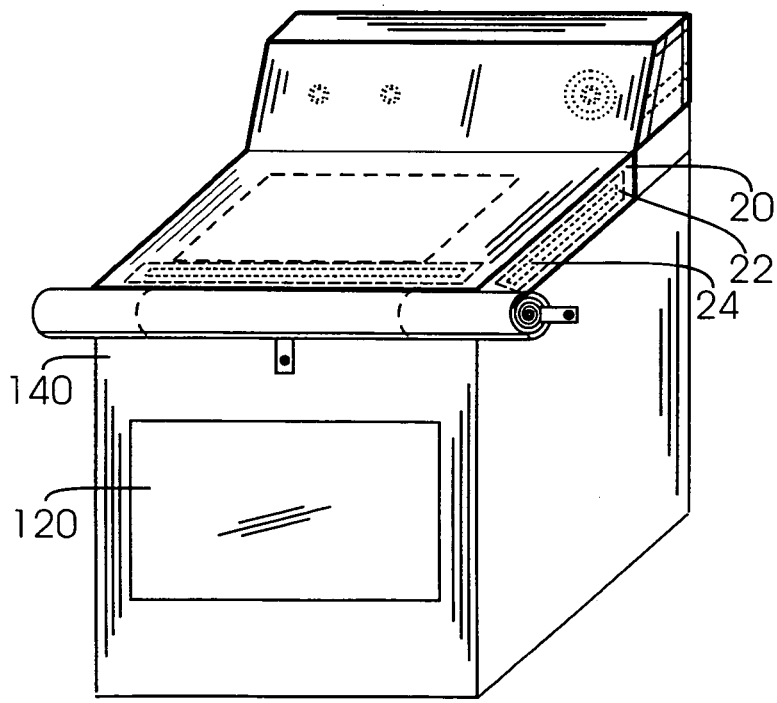
FIG. 4 is a perspective view of the present invention cover for a washer or dryer with the front side portion of the cover rolled back to gain access to the side entry door for a washer or dryer.

In its covering position as illustrated in FIGS. 1 and 2, the washer or dryer cover 10 fully covers the top 130 and front side 140 of the washer or dryer 100 and is retained in place by the respective side panels and the magnets supported thereon and the magnets on the interior of the top 12 and front 26 of the cover 10. It will be appreciated that it is within the spirit and scope of the present invention to have at least one side panel with a magnet therein to retain the cover or at least one magnet under the top 12 or front 26 to retain the cover. Referring to FIG. 3, to gain access to the front entry door 110 for a top loading washer or dryer, the side panel 14 and the oppositely disposed side panel are lifted away from the washer or dryer and the top section 12 is rolled forwardly as illustrated in FIG. 3. The front side section 26 of the washer or dryer cover 10 remains in place. In this way, the top access door 110 is exposed so that clothes can be placed into the washer or dryer 100 or removed from the interior of the washer or dryer 100 through the top access door 110. Referring to FIG. 4, to gain access to the front side entry door 120 for a front loading washer or dryer, the side panel 28 and the oppositely disposed side panel are lifted away from the washer or dryer and the front side section 26 is rolled upwardly as illustrated in FIG. 4. The top section 12 of the washer or dryer cover 10 remains in place. In this way, the front side access door 120 is exposed so that clothes can be placed into the washer or dryer 100 or removed from the interior of the washer or dryer 100 through the front side access door 120.

Figure 5:
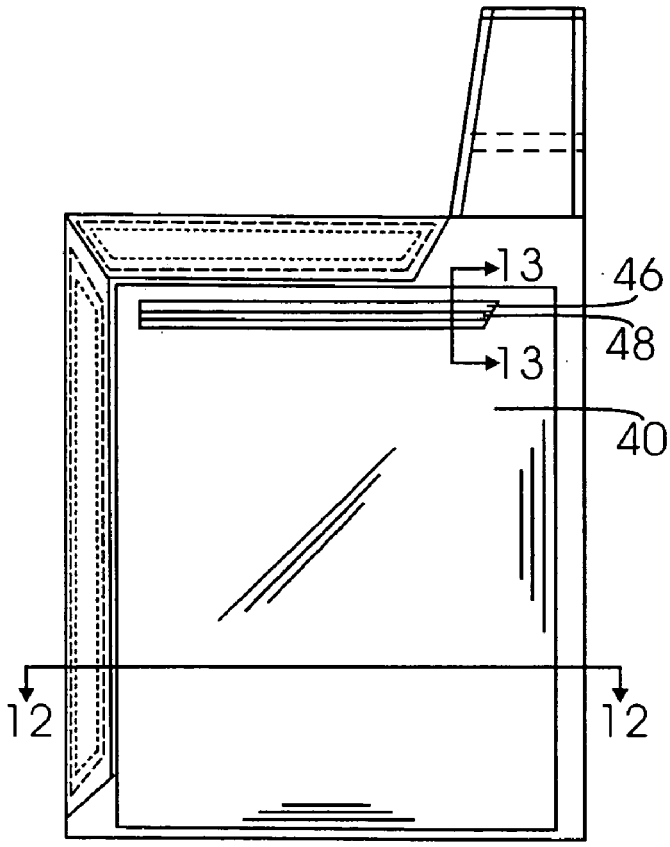
FIG. 5 is a perspective view of the present invention cover for a washer or dryer with an optional side cover which can cover the left side and/or the right side of the washer or dryer.
Figure 12:
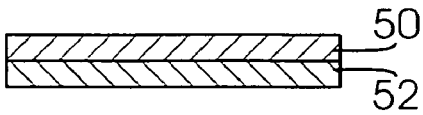
FIG. 12 is a cross-sectional view taken along line 12-12 of FIG. 5.
Figure 13:
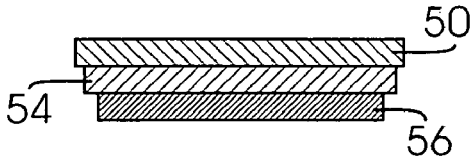
FIG. 13 is a cross-sectional view taken along line 13-13 of FIG. 5.

An optional covering feature to cover the left side and the right side of the washer or dryer is illustrated in FIG. 5. As illustrated in the cross-sectional view of FIG. 12, the right side cover section 40 has two layers, a top layer 50 and a bottom layer 52. Top layer 50 is made of waterproof material such as vinyl. Interior or second layer 52 is made of softer cushioning material such as foam or felt or other thick material. As illustrated in the cross-sectional view of FIG. 13, the within a cut out portion of interior layer 52 and against exterior layer 50 is a supporting layer 54 made of material such as rubber and a magnet 56 supported thereon. The magnet 56 serves to retain the washer or dryer cover on the right side 150 metal frame of the washer or dryer 100. It will be appreciated that there may be additional magnets located adjacent the bottom and on either side of the side cover 40. The side cover which will cover the left side of the washer or dryer 100 is the same as the right side cover 40.

Through use of the present invention, the washer or dryer 100 is completely covered and protected so that no moisture or other elements can attack or corrode the exterior of the washer or dryer 100. Easy access can be gained to the entry doors by means of the ability to roll the desired portion of the cover away to expose the access door while the cover is retained in place by the other portion of the cover which remains in place.

Defined in detail, the present invention is a A cover for a washer or a dryer having top surface, a front side surface, a right side surface and left side surface, an access door to the interior of the washing machine or dryer located in either the top surface or the front side surface, the cover comprising: (a) a top section having an outer layer made of water proof material and an interior layer made of soft fabric material, a first side panel having an exterior layer made of waterproof material and a magnet supported on a supporting layer within the first side panel, and a second side panel having an exterior layer made of waterproof material and a magnet supported on a supporting layer within the second side panel, the top section covering the top surface of the washer or dryer and retained thereon by the magnet of the first side panel attached to the right side surface of the washer or dryer and the magnet of the second side panel attached to the left side surface of the washer or dryer; (b) a front side section having an outer layer made of water proof material and an interior layer made of soft fabric material, a first side panel having an exterior layer made of waterproof material and a magnet supported on a supporting layer within the first side panel, and a second side panel having an exterior layer made of waterproof material and a magnet supported on a supporting layer within the second side panel, the front side section covering the front side surface of the washer or dryer and retained thereon by the magnet of the first side panel attached to the right side surface of the washer or dryer and the magnet of the second side panel attached to the left side surface of the washer or dryer; (c) the top surface capable of being rolled forwardly to uncover the top access door of the washer or dryer while the front side surface and its magnets on its first and second panels retain the cover on the washer or dryer; and (d) the front side surface capable of being rolled upwardly to uncover the front side access door of the washer or dryer while the top surface and its magnets on its first and second panels retain the cover on the washer or dryer.

Defined broadly, the present invention is a cover for a washer or a dryer having top surface, a front side surface, a right side surface and left side surface, an access door to the interior of the washing machine or dryer located in either the top surface or the front side surface, the cover comprising: (a) a top section having an outer layer made of water proof material and an interior layer made of soft fabric material and at least one side panel having an exterior layer made of waterproof material and a magnet supported on a supporting layer within the at least one side panel, the top section covering the top surface of the washer or dryer and retained thereon by the magnet of the at least one side panel attached to a side surface of the washer or dryer; (b) a front side section having an outer layer made of water proof material and an interior layer made of soft fabric material and at least one side panel having an exterior layer made of waterproof material and a magnet supported on a supporting layer within the at least one side panel, the front side section covering the front side surface of the washer or dryer and retained thereon by the magnet of the at least one side panel attached to a side surface of the washer or dryer; (c) the top surface capable of being rolled forwardly to uncover the top access door of the washer or dryer while the front side surface and its magnet on its at least one side panel retains the cover on the washer or dryer; and (d) the front side surface capable of being rolled upwardly to uncover the front side access door of the washer or dryer while the top surface and its magnet on its at least one side panel retains the cover on the washer or dryer.

Defined more broadly, the present invention is a cover for a washer or a dryer having top surface, a front side surface, a right side surface and left side surface, an access door to the interior of the washing machine or dryer located in either the top surface or the front side surface, the cover comprising: (a) a top section having an outer layer made of water proof material and at least one side panel having an exterior layer made of waterproof material and a magnet supported on a supporting layer within the at least one side panel, the top section covering the top surface of the washer or dryer and retained thereon by the magnet of the at least one side panel attached to a side surface of the washer or dryer; (b) a front side section having an outer layer made of water proof material and at least one side panel having an exterior layer made of waterproof material and a magnet supported on a supporting layer within the at least one side panel, the front side section covering the front side surface of the washer or dryer and retained thereon by the magnet of the at least one side panel attached to a side surface of the washer or dryer; (c) the top surface capable of being rolled forwardly to uncover the top access door of the washer or dryer while the front side surface and its magnet on its at least one side panel retains the cover on the washer or dryer; and (d) the front side surface capable of being rolled upwardly to uncover the front side access door of the washer or dryer while the top surface and its magnet on its at least one side panel retains the cover on the washer or dryer.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A cover for a washer or a dryer having top surface, a front side surface, a right side surface and left side surface, an access door to the interior of the washing machine or dryer located in either the top surface or the front side surface, the cover comprising:

a. a top section having an outer layer made of water proof material and an interior layer made of soft fabric material, a first side panel having an exterior layer made of waterproof material and a magnet supported on a supporting layer within the first side panel, and a second side panel having an exterior layer made of waterproof material and a magnet supported on a supporting layer within the second side panel, the top section covering the top surface of the washer or dryer and retained thereon by the magnet of the first side panel attached to the right side surface of the washer or dryer and the magnet of the second side panel attached to the left side surface of the washer or dryer;

b. a front side section having an outer layer made of water proof material and an interior layer made of soft fabric material, a first side panel having an exterior layer made of waterproof material and a magnet supported on a supporting layer within the first side panel, and a second side panel having an exterior layer made of waterproof material and a magnet supported on a supporting layer within the second side panel, the front side section covering the front side surface of the washer or dryer and retained thereon by the magnet of the first side panel attached to the right side surface of the washer or dryer and the magnet of the second side panel attached to the left side surface of the washer or dryer;

c. the top section of the cover capable of being rolled forwardly to uncover the top access door of the washer or dryer while the front side section of the cover and its magnets on its first and second panels retain the cover on the washer or dryer;

d. the front side section of the cover capable of being rolled upwardly to uncover the front side access door of the washer or dryer while the top section of the cover and its magnets on its first and second panels retain the cover on the washer or and;

e. the washer or dryer has a control panel which is also covered by the top surface section of the cover, the cover having a rubber strip adjacent each side of the control panel to retain the cover in place.

2. The cover in accordance with claim 1 further comprising a magnet supported on a supporting layer beneath the top section of the cover and another magnet supported on a supporting layer beneath the front side section of the cover.

3. The cover in accordance with claim 1 further comprising two side sections each having an outer layer made of water proof material and an interior layer made of soft fabric material, a magnet supported on a supporting layer within the side section, one side section covering the right side surface of the washer or dryer and the second side section covering the left side surface of the washer or dryer.

4. The cover in accordance with claim 3 wherein the outer layer of each side section is made of vinyl.

5. The cover in accordance with claim 1 wherein the outer layer of the top section is made of vinyl and the outer layer of the front side section is made of vinyl.

6. The cover in accordance with claim 1 wherein the interior layer of the top section of the cover and the interior layer of the front side section of the cover made of soft fabric material is made from the group selected from foam and felt.

7. The cover in accordance with claim 1 wherein an interior layer of each side section is made of soft fabric material is made from the group selected from and felt.

8. A cover for a washer or a dryer having top surface, a front side surface, a right side surface and left side surface, an access door to the interior of the washing machine or dryer located in either the top surface or the front side surface, the cover comprising:

a. a top section having an outer layer made of water proof material and an interior layer made of soft fabric material and at least one side panel having an exterior layer made of waterproof material and a magnet supported on a supporting layer within the at least one side panel, the top section covering the top surface of the washer or dryer and retained thereon by the magnet of the at least one side panel attached to a side surface of the washer or dryer;

b. a front side section having an outer layer made of water proof material and an interior layer made of soft fabric material and at least one side panel having an exterior layer made of waterproof material and a magnet supported on a supporting layer within the at least one side panel, the front side section covering the front side surface of the washer or dryer and retained thereon by the magnet of the at least one side panel attached to a side surface of the washer or dryer;

c. the top section of the cover capable of being rolled forwardly to uncover the top access door of the washer or dryer while the front side section of the cover and its magnet on its at least one side panel retains the cover on the washer or dryer;

d. the front side section of the cover capable of being rolled upwardly to uncover the front side access door of the washer or dryer while the top section of the cover and its magnet on its at least one side panel retains the cover on the washer or dryer; and e. the washer or dryer has a control panel which is also covered by the top section of the cover, the cover having a rubber strip adjacent each side of the control panel to retain the cover in place.

9. The cover in accordance with claim 8 further comprising a magnet supported on a supporting layer beneath the top section of the cover and another magnet supported on a supporting layer beneath the front side section of the cover.

10. The cover in accordance with claim 8 further comprising at least one side section having an outer layer made of water proof material and an interior layer made of soft fabric material, a magnet supported on a supporting layer within the at least one side section, the at least one side section covering a side surface of the washer or dryer.

11. The cover in accordance with claim 10 wherein the outer layer of the at least one side section is made of vinyl.

12. The cover in accordance with claim 10 wherein the interior layer of soft fabric material is made from the group selected from foam and felt.

13. The cover in accordance with claim 8 wherein the outer layer of the top section is made of vinyl and the outer layer of the front side section is made of vinyl.

14. The cover in accordance with claim 8 wherein the interior layer of the top section of the cover and the interior layer of the front section of the cover made of soft fabric material is made from the group selected from foam and felt.

15. A cover for a washer or a dryer having top surface, a front side surface, a right side surface and left side surface, an access door to the interior of the washing machine or dryer located in either the top surface or the front side surface, the cover comprising:

a. a top section having an outer layer made of water proof material and at least one side panel having an exterior layer made of waterproof material and a magnet supported on a supporting layer within the at least one side panel, the top section covering the top surface of the washer or dryer and retained thereon by the magnet of the at least one side panel attached to a side surface of the washer or dryer;

b. a front side section having an outer layer made of water proof material and at least one side panel having an exterior layer made of waterproof material and a magnet supported on a supporting layer within the at least one side panel, the front side section covering the front side surface of the washer or dryer and retained thereon by the magnet of the at least one side panel attached to a side surface of the washer or dryer;

c. the top section of the cover capable of being rolled forwardly to uncover the top access door of the washer or dryer while the front side section of the cover and its magnets on its at least one side panel retains the cover on the washer or dryer;

d. the front side section of the cover capable of being rolled upwardly to uncover the front side access door of the washer or dryer while the top section of the cover and its magnet on its at least one side panel retains the cover on the washer or dryer; and e. the washer or dryer has a control panel which is also covered by the top section of the cover, the cover having a rubber strip adjacent each side of the control panel to retain the cover in place.

16. The cover in accordance with claim 15 further comprising a magnet supported beneath the top section of the cover and another magnet supported beneath the front side section.

17. The cover in accordance with claim 15 further comprising at least one side section of the cover having an outer layer made of water proof material and a magnet supported on a supporting layer within the at least one side section of the cover, the at least one side section of the cover covering a side surface of the washer or dryer.

18. The cover in accordance with claim 17 wherein the outer layer of the at least one side section of the cover is made of vinyl.

19. The cover in accordance with claim 15 wherein the outer layer of the top section of the cover is made of vinyl and the outer layer of the front side section is made of vinyl.

* * * * *